United States Patent [19]

Patterson, Jr. et al.

[11] Patent Number: 4,568,400

[45] Date of Patent: Feb. 4, 1986

[54] CIRCULAR CABLE COATING NOZZLE FOR APPLYING WATERPROOF COVERING TO CABLES

[75] Inventors: Harold T. Patterson, Jr., Stone Mountain; Vernon L. Hetrick, Marietta; Richard M. Davis, Norcross, all of Ga.

[73] Assignee: Nordson Corporation, Amherst, Ohio

[21] Appl. No.: 648,800

[22] Filed: Sep. 7, 1984

[51] Int. Cl.[4] ..... H01B 13/14

[52] U.S. Cl. ..... 156/48; 156/51; 156/54; 156/56; 156/244.12; 156/500; 264/176 R; 425/113; 427/120

[58] Field of Search ..... 156/48, 51, 56, 244.11, 156/244.12, 500, 54; 264/173, 176 R, 174; 425/113, 114, 382 R, 464; 427/117, 120

[56] References Cited

U.S. PATENT DOCUMENTS 4,122,145 10/1978 Hartmann ..... 427/120 X
4,451,306 5/1984 Verne ..... 156/51
4,468,435 8/1984 Shimba et al. ..... 156/51 X
4,469,539 9/1984 Wade et al. ..... 156/51
4,493,747 1/1985 Kanotz et al. ..... 156/244.12 X

FOREIGN PATENT DOCUMENTS 3144851 5/1983 Fed. Rep. of Germany .
3236491 4/1984 Fed. Rep. of Germany .

*Primary Examiner*—Robert A. Dawson
*Attorney, Agent, or Firm*—Wood, Herron & Evans

[57] ABSTRACT

A method and apparatus for coating telephone cable or other continuous lengths of cylindrical objects with a continuous coating of molten thermoplastic sealant material. The cable or cylindrical object is passed through an annular array of nozzles operative to apply multiple beads of molten thermoplastic material to the surface of the cable or object. A liquid impervious casing is then placed over the bead coated cable while the beads are still in a molten state. The casing compresses the beads and forms them into a continuous coating of thermoplastic material surrounding the cable or object and contained within the liquid impervious casing.

14 Claims, 5 Drawing Figures

CIRCULAR CABLE COATING NOZZLE FOR APPLYING WATERPROOF COVERING TO CABLES

This invention relates to a molten thermoplastic applicator nozzle, and more particularly to a nozzle for applying molten thermoplastic material to the peripheral surface of a cylindrical cable so as to encase that cable in a waterproof casing.

It has been a prior art practice to encase or enshroud telephone line cable—which may comprise several hundred or even thousand twisted pairs of insulated cable—within a multiple ply sheathing. Conventionally, this casing has consisted of aluminum sheet metal casing surrounded by an static polypropylene coating and encased within a corrugated steel casing. To better waterproof this cable it has been a prior art practice to flood the casing internally of the corrugated aluminum sheet metal casing with a viscous waterproofing liquid. This liquid conventionally has the consistency of a light grease and functions to prevent moisture from entering the cable or travelling longitudinally within the cable if moisture does penetrate the casing surrounding the cable.

There has been a longstanding problem with kinking and fracture of the cable sheathing when the cable is bent. Additionally, there has been a longstanding problem with telephone cable of maintaining the waterproof seal whenever the outer casing is fractured or broken for whatever reason. In the absence of a good waterproof seal, moisture may travel along the length of the cable and create a maintenance problem because of the difficulty of locating and repairing a short as well as the break in the cable. It has therefore been an objective of this invention to provide an improved method for waterproofing cable as well as an improved apparatus for applying that waterproofing material to the cable.

According to the practice of this invention, molten thermoplastic sealant material is applied by an annular array of nozzles to the peripheral surface of the cable as the cable moves past the array of nozzles and before the cable is encased within a surrounding sheathing. The surrounding sheathing is placed over the cable immediately after application of the molten thermoplastic sealant material while the material is still in a molten state. The surrounding sheathing is then operative to compress the molten thermoplastic sealant material and form it into a continuous layer of protective waterproofing sealant surrounding the cable and located internally of the protective sheathing.

To apply this waterproofing sealant material, an annular array of beads of molten thermoplastic sealant is applied to the cable. The invention of this application employs a heated body having a generally cylindrical interior surface adapted to be located in juxtaposition to the exterior surface of a cable passing through the body. This cylindrical surface is intersected by a plurality of radially extending bores within each one of which there is mounted a threaded bushing containing a threaded nozzle. Each of the radial bores is in turn connected to flow passages contained internally of the body through which molten thermoplastic sealant material is supplied to the nozzles. This molten thermoplastic material is supplied to the body from a conventional source of molten material.

The primary advantage of this invention is that it enables a cable to be more completely sealed with a waterproofing sealant than has heretofore been possible using prior art flooding practices. Consequently, the problem of maintenance and repair of cables to which this coating is applied is substantially reduced.

These and other objects and advantages of this invention will be more readily apparent from the following description of the drawings in which.

Figure 1:
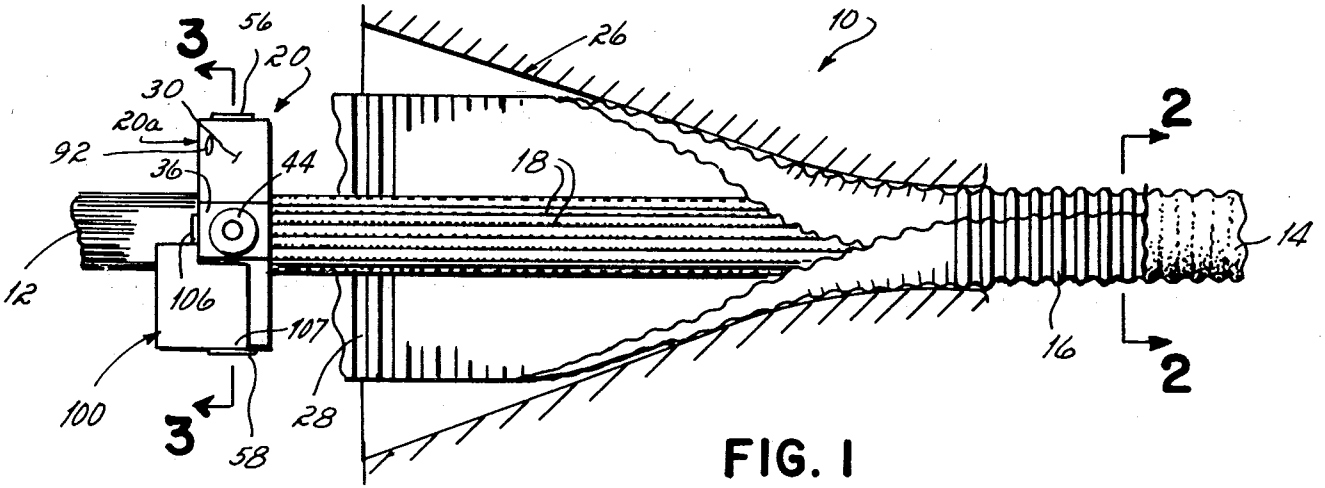
FIG. 1 is a side elevational view of a portion of a cable coating line incorporating the invention of this application.

Referring first to FIG. 1, there is illustrated a portion of a production line 10 for coating a cable 12 with a coating of sealant and then encasing that sealant coated cable within a corrugated metal sheath 16. While the invention is described herein as being utilized to coat telephone line cable, it should be appreciated that the invention is equally applicable to coat other cylindrical objects such as braided hose or other similarly configured cylindrical objects.

Figure 2:
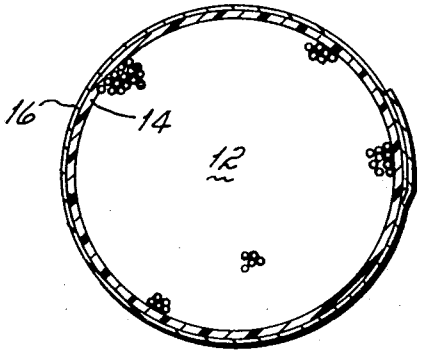
FIG. 2 is an enlarged cross sectional view taken on line 2—2 of FIG. 1.

According to the practice of this invention, the cable 12 which may comprise hundreds or even thousands of twisted pairs of insulated telephone lines, is passed through a circular array of nozzles 22 (FIG. 3) contained within a hollow body 20. In the course of passing through this array of nozzles, multiple beads 18 (FIG. 3) of molten thermoplastic sealant is applied thereto from the array of nozzles. The coated cable, having the beads 18 of molten thermoplastic applied thereto, is then passed through a generally funnel-shaped forming die 26 into which a flat sheet of corrugated metal is simultaneously fed. The cable and the metal sheet move into the forming die at the same speed. The forming die is operative to form the flat sheet 16 of corrugated metal into an overlapped cylindrical configuration. In the course of forming the corrugated sheet metal 28 into a cylindrical casing 16 surrounding the cable, the sheath compresses the beads of still molten material and forms it into a continuous coat 14 (see FIG. 2) of thermoplastic material. The compressed coating 14 of molten thermoplastic material then cools and, in the course of cooling, solidifies to form an impervious or waterproof coating of sealant material surrounding and subsequently encasing the cable 12.

In a preferred embodiment of this invention, twenty-four beads 18 of molten thermoplastic material are simultaneously applied to the cable 12 as the cable passes through the hollow body 20 and the array of nozzles 22 contained within that body. The number of beads and nozzles operative to apply these beads is a function of the size of the cable and the quantity of sealant material required to be applied to form the continuous coating 14. In one preferred practice of this invention twenty-four beads were found to be satisfactory for coating a cable $1\frac{3}{4}''$ in diameter. Of course a lesser number would be satisfactory for coating a smaller diameter cable and a greater number would be required to coat a larger cable. The number of nozzles is also a function of the sealant material being applied to the material. More viscous material requires a greater number of nozzles and less viscous materials require less nozzles.

Figure 3:
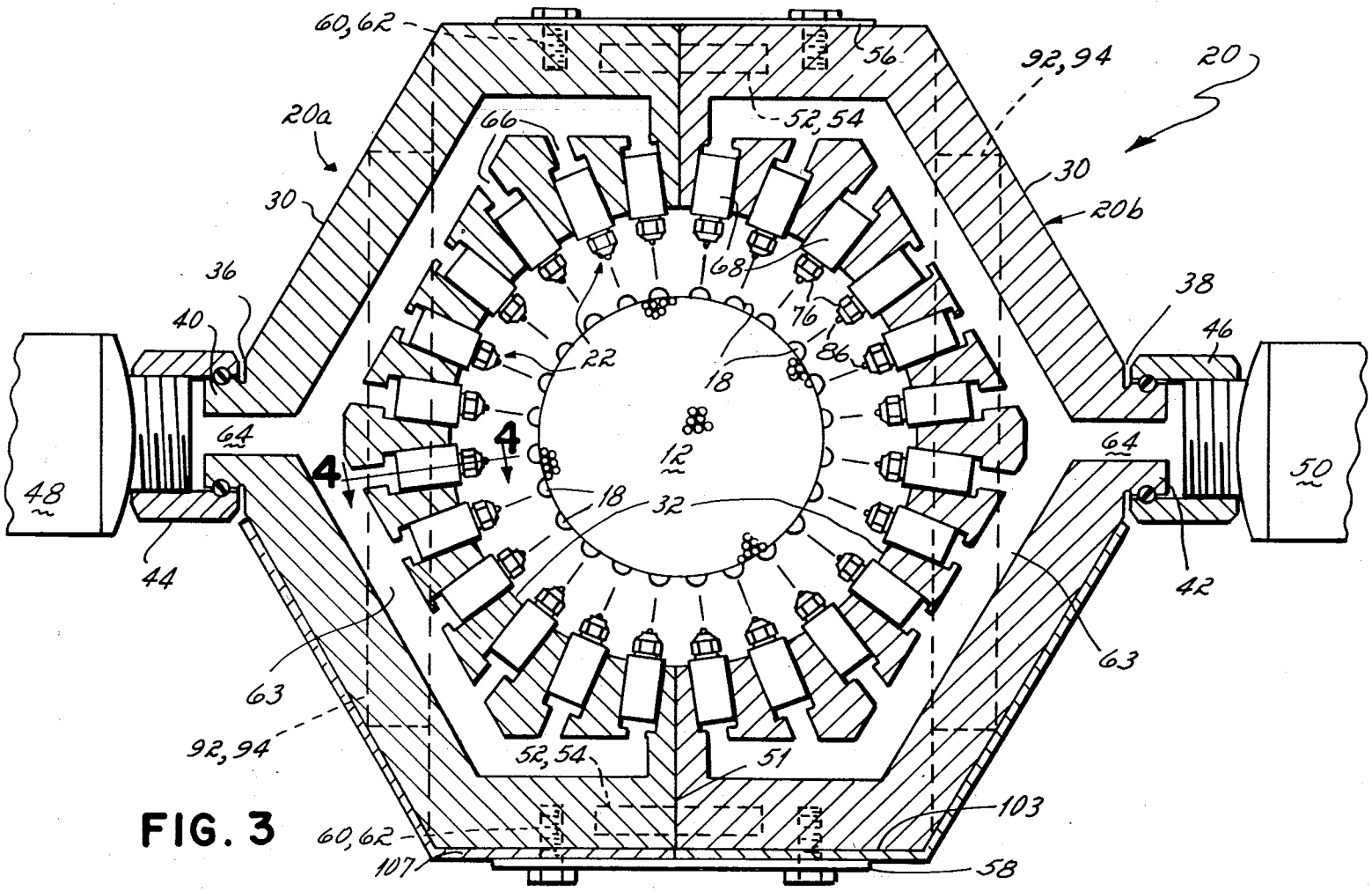
FIG. 3 is an enlarged cross sectional view taken on line 3—3 of FIG. 1.
Figure 5:
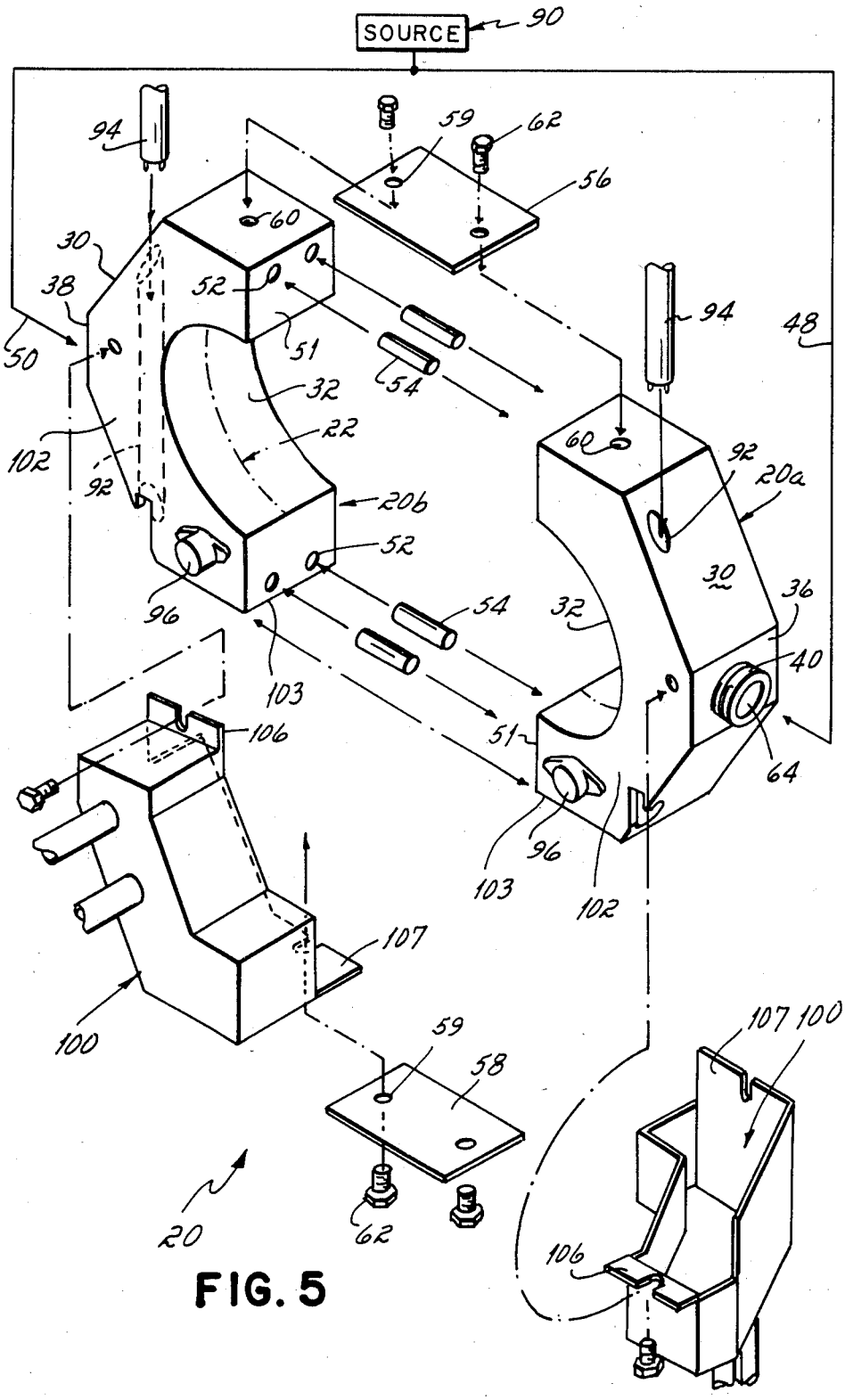
FIG. 5 is an exploded perspective view of the nozzle supporting body of FIG. 1 but with the nozzle bushings and nozzle inserts removed for clarity of the drawing.

With reference to FIGS. 3 and 5, it will be seen that the nozzle containing body 20 has an outer peripheral surface 30 which is generally hexagonal in configuration and an inner surface 32 which is generally cylindrical. Flats 36, 38 are formed on two opposed corners of the hexagonal shaped body 20 and nipples 40, 42 extend outwardly from these flats. These nipples are adapted to receive fittings 44, 46, respectively for attaching the nipples to conduits 48, 50 through which molten thermoplastic material is supplied to the body 20.

The body 20 is formed in two sections 20*a*, 20*b* such that the body may be easily assembled over a cable or removed from the cable for purposes of assembly and removal or for purposes of cleaning the nozzles, etc.

With reference to FIG. 5 it will be seen that opposed faces of the two halves 20*a*, 20*b* of the body 20 are provided with bores or blind holes 52 for the reception of dowels 54 which function to align the two halves of the body during assembly. When the two halves are assembled they are secured together by assembly plates 56, 58 which span the two halves and which have holes extending therethrough and matching threaded bores 60 in the two halves 20*a*, 20*b* of the body. To assemble the two halves of the body, the opposed faces 51 of the two halves are placed in juxtaposition with the dowels fitted within the holes 52. The plates 56 are then placed over the top and bottom of the body so as to span the interface therebetween. The two threaded bolts 62 are then inserted through the holes 59 and into the threaded bores 60 of the body halves to secure the two halves of the body in an assembled relation.

Each half 20*a*, 20*b* of the body is provided with a series of interconnected flow passages 63 which are interconnected to a bore 64 of their nipples 40, 42. These flow passages 63 are intersected by counterbored radial bores 66 within each one of which there is located a nozzle receiving bushing 68. The bushings are sealingly mounted within the counterbored bores 66, as for example by being brazed therein.

Figure 4:
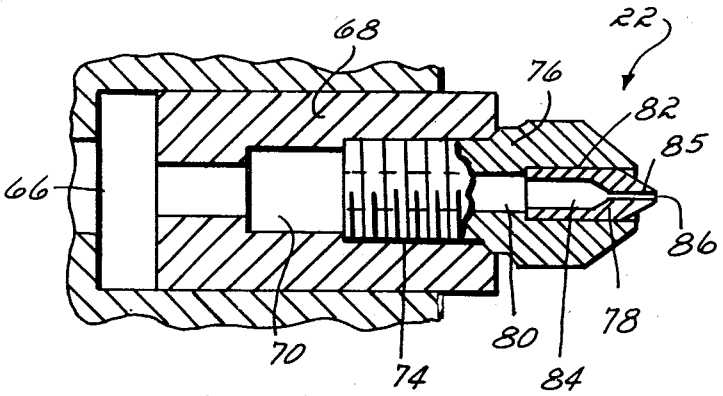
FIG. 4 is a cross sectional view taken on line 4—4 of FIG. 3.

Each of the bushings 68 is generally tubular in configuration and has an axial bore 70 extending therethrough. This bore is counterbored and threaded at its inner end, as may be most clearly seen in FIG. 4. The threaded section 74 of the bore is adapted to receive an externally threaded portion of a nozzle 22.

Each nozzle 22 comprises a nozzle adapter 76 and a nozzle insert 78. The nozzle adapters are externally threaded on their inner ends for reception into the threaded section 74 of a bushing 68. An axial bore 80 extends through each nozzle adapter. The bore 80 is counterbored at its inner end for reception of a nozzle insert 78. The inserts are brazed into the counterbored end section 82 of the nozzle adapter 76. Each insert has an axial bore 84 which terminates at its inner end in a small diameter discharge passage 85 and outlet port or orifice 86.

With reference to FIGS. 3 and 5, it will be seen that there is a vertical bore 92 which extends through each half 20*a*, 20*b* of the body 20 to one side of the flow passages 63. An electrical resistance heater 94 is mounted within each of these bores 92. Electrical power to these heaters is controlled by a thermostat 96 mounted on one side of each of the body halves 20*a*, 20*b*. Electrical leads (not shown) contained within a sheet metal housing 100 mounted on the side of each body half 20*a*, 20*b* supply electrical power to the heaters 94 so as to maintain the body 20 at a preset temperature operative to maintain molten sealant material contained in the passages 63, 64, 66 in a molten state.

With reference to FIGS. 1 and 5, it will be seen that each sheet metal housing 100 fits over a portion of one side 102 of each half 20*a*, 20*b* of the body 20. The sole purpose of this hollow housing is to encase the electrical leads and thermostats 96 within an enclosure. Each housing 100 has flanges 106, 107 thereon adapted to be placed in juxtaposition to the flat surfaces of the sides 102 and the lower surfaces 103 respectively of the body and to be secured thereto by bolts 108 and lower bolts 62 which extend through slots in the flanges and are threaded into threaded bores 110 and 60 of the nozzle supporting body 20, the lower plate 58 also being held in place by the bolts 62 as discussed above.

In the course of use of the nozzle containing body 20, molten thermoplastic material is supplied from a source 90 of such material via the conduits 48, 50 to the inlet ports 64 of the body. This molten material is then distributed through the passages 63 of the body to the radial passages 66. The molten material flows through these passages 66, through the axial bores 70 of the bushings 68, and through the bores of the nozzles 22 to the outlet orifices 86. Molten thermoplastic material emerges from the nozzle orifices 86 and is deposited as a series of beads 18 on the peripheral surface of the cable 12 as the cable passes through the circular array of nozzles. The cable 12 having the beads 18 of thermoplastic material deposited thereon is then fed simultaneously with the corrugated sheathing 28 into the forming die 26 wherein the sheathing is formed into a cylindrical configuration surrounding the cable. In the course of being formed into a cylindrical configuration, the sheathing 28 compresses the beads 18 of thermoplastic material while they are still in a molten state and forms them into a continuous coating 14 of thermoplastic material surrounding the cable 12.

The primary advantage of the apparatus and method described hereinabove is that it enables a cylindrical cable or other cylindrical object to be coated with a coating of molten thermoplastic material and encased within a surrounding protective sheath. The practice of this method effects a very complete coating of the surface of the cylindrical object. Furthermore, this apparatus is so constructed that it may be easily maintained and cleaned in the event that any of the nozzles of the apparatus become clogged.

While we have described a single preferred embodiment of our invention, persons skilled in this art will appreciate changes and modifications which may be made without departing from the spirit of our invention. For example, such persons will readily appreciate that the invention is applicable to the coating of other cylindrical objects with a foamed thermoplastic material as well as with conventional solid thermoplastic material. Therefore, we do not intend to be limited except by the scope of the following appended claims.

We claim:

1. Apparatus for applying molten thermoplastic material to a cable of electrically insulated wires so as to encase and waterproof said cable in a sheath of thermoplastic material, said cable having a generally cylindrical peripheral surface, said apparatus comprising a body, said body having a generally cylindrical interior surface adapted to be located in juxtaposition to the exterior surface of said cable, a plurality of generally radially extending bores contained in said body, each of said bores having an outlet end which intersects said cylindrical interior surface, and a plurality of interconnected flow passages contained interiorly of said body, each of said generally radially extending bores being intersected by at least one of said flow passages, an inlet adapter secured to said body and in fluid communication with said interconnected flow passages, a plurality of bushings, one of said bushings being sealingly secured within each of said bores, each of said bushings having a threaded interior surface, and a plurality of nozzles, each of said nozzles having a threaded exterior surface, and one of said nozzles being threaded within each of said bushings.

2. The apparatus of claim 1 wherein said body comprises multiple sections, each section of which has an arcuate portion of said cylindrical surface thereon.

3. The apparatus of claim 1 wherein said body has an electrical resistance heater mounted therein.

4. The apparatus of claim 3 wherein an electrical thermostat is mounted upon said body for controlling the flow of electrical power to said heater.

5. The apparatus of claim 1 wherein each of said nozzles comprises a nozzle adapter threaded into one of said bushings, and a nozzle insert sealingly mounted within a bore of said nozzle adapter.

6. Apparatus for applying liquid impervious coating to a generally cylindrical bundle of electrical wires, said apparatus comprising, an annular array of nozzles.

means for passing a bundle of wires through said annular array of nozzles, said nozzles being directed toward the center of said bundle, means for supplying molten thermoplastic material to said nozzles, means for directing multiple parallel beads of said molten thermoplastic material from said nozzles onto the surface of said bundle of wires, and means for applying a casing around said bundle while said beads of thermoplastic material are still in a molten state so as to compress said beads of themoplastic material into a continuous coating of thermoplastic material surrounding said bundle and contained within said casing.

7. The apparatus of claim 1 wherein a bushing is sealingly mounted in each radial bore of said body, said bushing having internal threads therein, and one of said array of nozzles being mounted within each of said bushings.

8. The apparatus of claim 6 wherein said array of nozzles is mounted within a heated body.

9. The apparatus of claim 8 wherein said body has at least one electrical resistance heaters mounted therein.

10. The apparatus of claim 9 wherein an electrical thermostat is mounted upon said body for controlling the flow of electrical power to said heater.

11. The apparatus of claim 6 wherein said array of nozzles is mounted within a body, said body being made from multiple sections, each section of which has a plurality of said array of nozzles mounted therein.

12. Apparatus for applying a liquid impervious coating to a generally cylindrical object, said apparatus comprising, an annular array of nozzles, said nozzles having discharge orifices generally passing a bundle of wire through said annular array, said nozzles being directed toward a common center of said array, means for supplying molten thermoplastic material to said nozzles, means for directing multiple parallel beads of said molten thermoplastic material from said nozzles onto the surface of a cylindrical object as said object is passed through said annular array of nozzles, and means for applying a casing around the cylindrical object while said beads of thermoplastic material are still in a molten state thereon so as to compress said beads of thermoplastic material into a continuous coating of thermoplastic material surrounding said object and contained within said casing.

13. A method of applying a waterproof coating to a generally cylindrical bundle of electrical wires, said method comprising, passing said bundle of wire through an annular array of nozzles directed toward the center of said bundle, supplying molten thermoplastic material to said nozzle, directing multiple parallel beads of said molten thermoplastic material from said nozzles onto the surface of said bundle of wires, applying a liquid impervious casing around said bundle while said beads of thermoplastic material are still in a molten state so as to compress said beads of thermoplastic material into a continuous coating of thermoplastic material surrounding said bundle and contained within said casing.

14. A method of applying a waterproof coating to a generally cylindrical object, said method comprising, passing said object through an annular array of nozzles directed toward the center of said array, supplying molten thermoplastic material to said nozzles, directing multiple parallel beads of said molten thermoplastic material from said nozzles onto the surface of said object, and applying a liquid impervious casing around said object while said beads of thermoplastic material are still in a molten state so as to compress said beads of thermoplastic material into a continuous coating of thermoplastic mateial surrounding said object and contained within said casing.

* * * * *